US005763847A

United States Patent [19]

Moldovan et al.

[11] Patent Number: 5,763,847

[45] Date of Patent: Jun. 9, 1998

[54] ELECTRIC CURRENT SWITCHING APPARATUS WITH TORNADIC ARC EXTINGUISHING MECHANISM

[75] Inventors: Peter K. Moldovan, Cascade; Mark A. Juds, New Berlin, both of Wis.

[73] Assignee: Eaton Corporation, Cleveland, Ohio

[21] Appl. No.: 728,108

[22] Filed: Oct. 9, 1996

[51] Int. Cl.[6] ..... H01H 33/18; H01H 9/30

[52] U.S. Cl. ..... 218/38; 218/22; 218/149

[58] Field of Search ..... 218/22, 26, 29, 218/34, 38, 147, 149, 151; 235/16, 201

[56] References Cited

U.S. PATENT DOCUMENTS

| | | | |
|---|---|---|---|
| 2,051,478 | 8/1936 | Hampton et al. | 200/144 |
| 2,596,865 | 5/1952 | Peter | 218/151 |
| 4,056,798 | 11/1977 | Malick | 335/16 |
| 4,079,219 | 3/1978 | Weston | 200/147 R |
| 4,539,451 | 9/1985 | Mori et al. | 200/147 R |
| 4,568,805 | 2/1986 | Wycklendt | 200/147 |
| 5,004,874 | 4/1991 | Theisen et al. | 200/144 |
| 5,138,122 | 8/1992 | Moldovan et al. | 200/144 R |
| 5,416,455 | 5/1995 | Moldovan et al. | 335/132 |

*Primary Examiner*—J. R. Scott
*Assistant Examiner*—Michael J. Hayes
*Attorney, Agent, or Firm*—Quarles & Brady

[57] ABSTRACT

A contactor for switching electric current has a stationary contact and a movable contact which when driven by a solenoid moves into and away from abutment with the stationary contact. An arc extinguishing chamber is adjacent to the movable and stationary contacts and includes two rows of splitter plates with a gap therebetween. Each row comprises alternating splitter plates of first and second types. The first type of splitter plate has a first member of non-magnetic material with an aperture within which a permanent magnet is received and a second member of a magnetic material abutting the first member remote from the gap. An outer casing of a non-ferrous, electrically conductive material extends at least partially around the first and second members. The second type of splitter plates are formed of non-ferrous, electrically conductive material. The magnets produce a magnetic field around each of the first type of splitter plates which causes the electric arc to move about the surface of the outer casing.

19 Claims, 2 Drawing Sheets

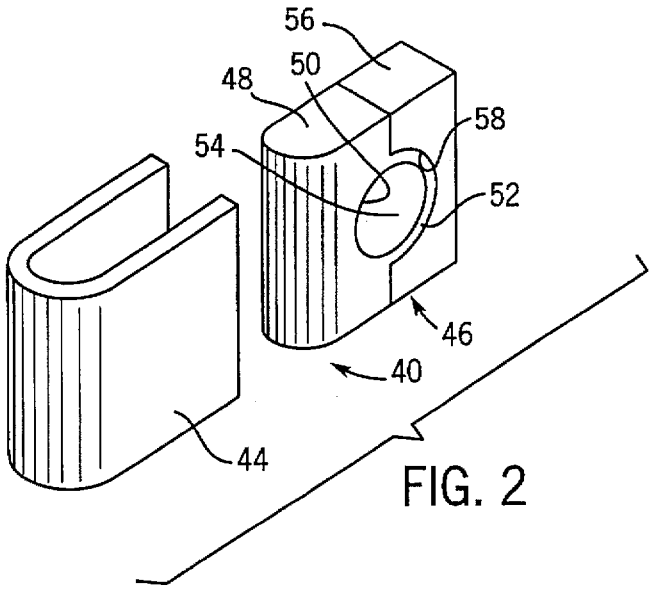
FIG. 2
FIG. 3
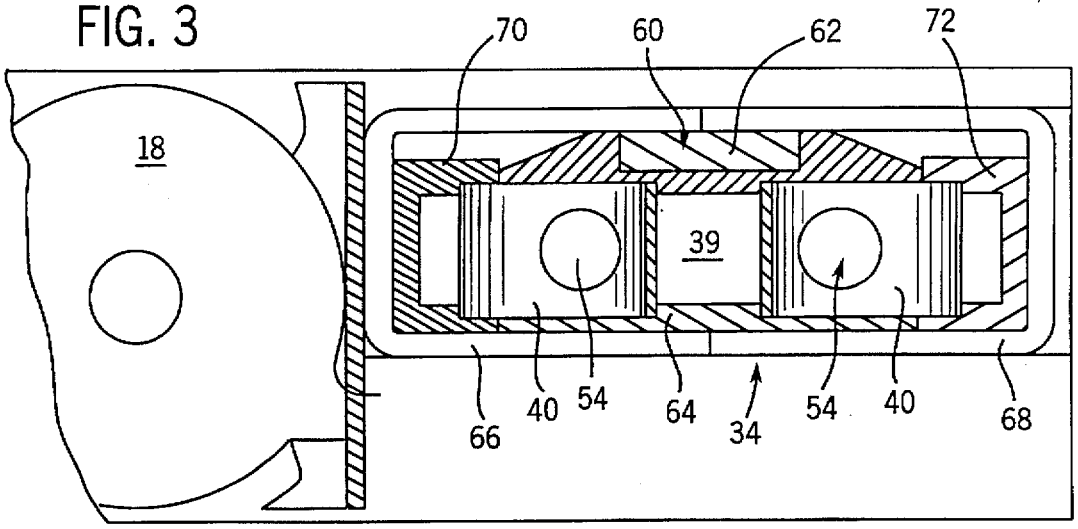
FIG. 4
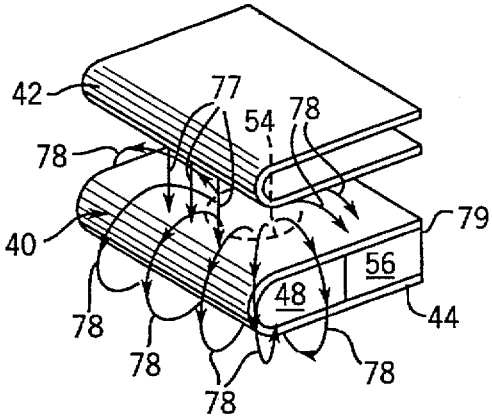

ELECTRIC CURRENT SWITCHING APPARATUS WITH TORNADIC ARC EXTINGUISHING MECHANISM

BACKGROUND OF THE INVENTION

This invention relates to apparatus for switching electric current, such as direct current (DC) electricity; and more particularly to such apparatus which has a mechanism for extinguishing arcs formed between switch contacts during separation.

DC electricity is used in a variety of applications such as battery powered systems, drives for motors and DC accessory circuits. Contactors typically are provided between the DC supply and the load to apply and remove electric power to the load. Weight, reliability and high DC voltage switching and interrupting capability are important considerations in developing the contactor. Furthermore, in many applications relatively large direct currents must be switched which produce arcs when the contacts of the contactor separate, thereby requiring a mechanism for extinguishing the arcs.

Previous DC contactors and switches incorporated one or more arc extinguishing chambers, often referred to as "arc chutes" such as describe in U.S. Pat. No. 5,416,455, to extinguish arcs that formed between the switch contacts. Arc extinguishing chambers may comprise a series of spaced apart splitter plates of a non-ferrous, electrically conductive material, such as copper. In DC switching devices, permanent magnets on the sides of the series of splitter plates establish a magnetic field across the arc extinguishing chamber which directs arcs into splitter plate arrangement.

The arc then propagates from one splitter plate to another in the series and eventually the arc spans a number of gaps between the splitter plates whereby sufficient arc voltage is built up that the arc is extinguished. By design, the arc in DC switching devices is stabilized in one spot on a given splitter plate to uniformly build up the arc voltage in the series of splitter plates. This concentration of energy at one spot erodes the metal plate, particularly when the arc duration is relatively long as occurres with inductive loads.

SUMMARY OF THE INVENTION

A general object of the present invention is to provide an improved switching apparatus for electric current.

Another object is to provide a current switching apparatus with a mechanism that extinguishes arcs that form while the switch contacts separate.

A further object of the present invention is to reduce arc induced erosion of components of the extinguishing mechanism.

Yet another object is to provide internal magnetic fields that cause the arc to move continuously about the surfaces of the arc extinguishing mechanism.

These and other objects are fulfilled by an electric current switching apparatus that includes a pair of terminals with a stationary contact electrically connected to one power terminal. A movable contact selectively engages the stationary contact to establish an electrical connection between the two terminals. An arc extinguishing chamber is adjacent to the movable and stationary contacts and has a plurality of a first type of splitter plates. Each of these splitter plates has an element of a non-ferrous, electrically conductive material with an aperture that holds a permanent magnet which produces a magnetic field around the element. Interaction of an arc within the chamber with this magnetic field causes the arc to move about the surface of the element. Thus the arc does not impinge the element in one place for a prolonged time and the element is subjected to reduced erosive forces.

In the preferred embodiment, each of the first type of splitter plates has a first member of non-magnetic material with an aperture within which the permanent magnet is received and a second member of a magnetic material abutting the first member and having a notch within which a portion of the first member is located. A casing of a non-ferrous, electrically conductive material extends at least partially around the first and second members and provides a surface for the arc to impinge. Another magnet assembly may be provided adjacent to the stationary movable contacts for establishing a magnetic field that causes a DC electric arc to move into the arc extinguishing chamber.

BRIEF DESCRIPTION OF THE DRAWINGS

FIG. 2 is an isometric view of one type of splitter plate used in the arc extinguishing chamber;

FIG. 3 is a cross-sectional view of the extinguishing chamber along line 3—3 in FIG. 1; and FIG. 4 is a isometric view of two adjacent splitter plates in the extinguishing chamber and depicts interaction of the magnetic field and electric current.

DETAILED DESCRIPTION OF THE INVENTION

Figure 1:
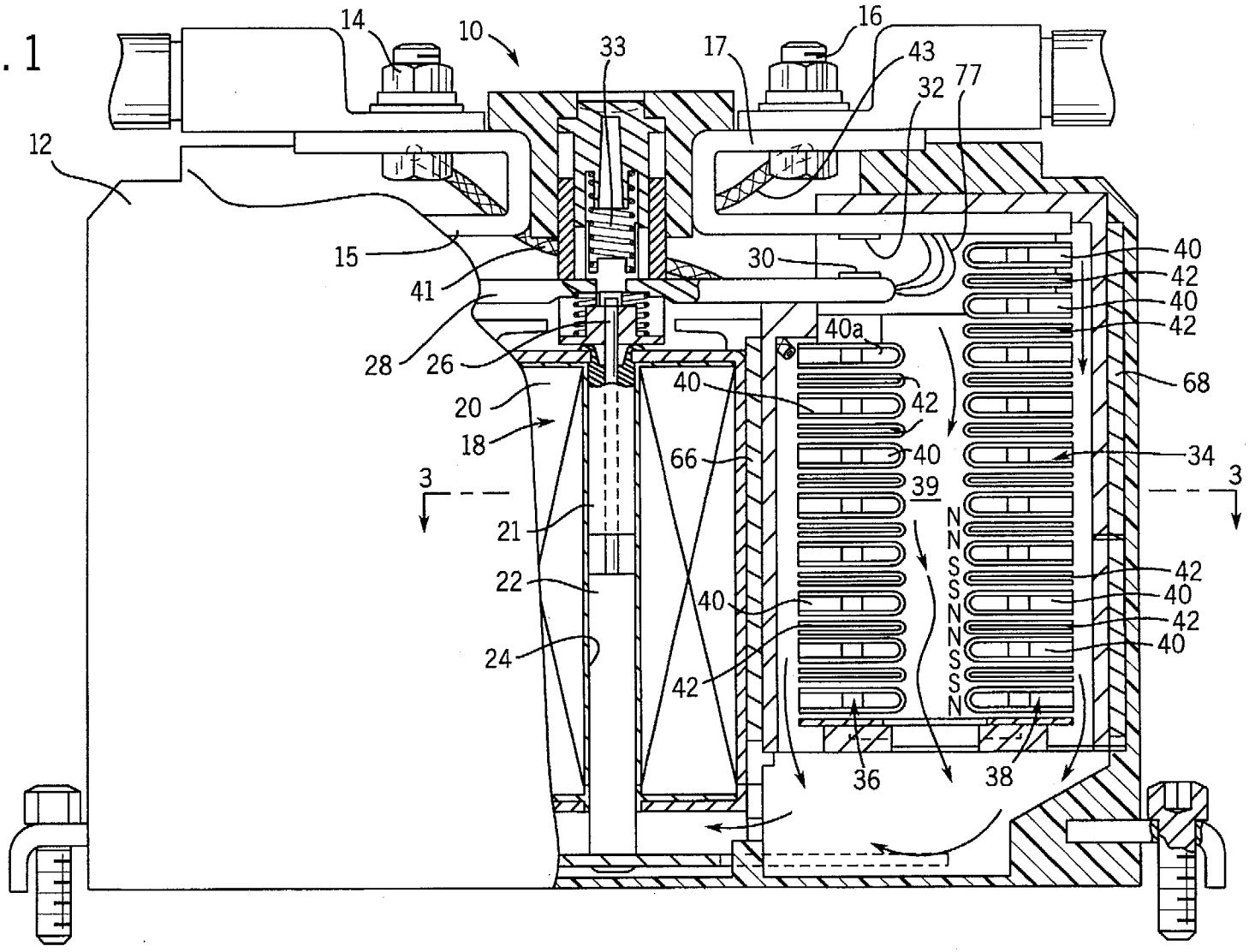
FIG. 1 is a cut away view of a direct current contactor incorporating an arc extinguishing chamber according to the present invention.

With reference to FIG. 1, a sealed electromagnetic single pole contactor 10 has a plastic housing 12 with first and second power terminals 14 and 16. The first power terminal 14 is connected to a first stationary contact 15 attached to the housing and the second power terminal 16 is connected to a second stationary contact 17.

Inside the contactor 10 is an electromagnetic solenoid 18 which nests in recesses in the interior surfaces of the housing 12. The solenoid 18 has an annular coil 20, a core 21 and an armature 22 located within the central opening 24. The armature 22 includes a shaft 26 that passes through the core 21 and connects to a moveable contact arm 28, which in the closed state of the contactor 10 bridges the two stationary contacts 15 and 17 completing an electrical path between the terminals 14 and 16. Each end of the moveable contact arm 28 has a contact pad 30 which in the closed state abuts a mating contact pad 32 on the stationary contact 15 or 17 associated with that end of the moveable contact arm. A spring assembly 33 biases the moveable contact arm 28 and the armature 22 so that the contactor 10 is in a normally open position when the solenoid coil 20 is deenergized, as illustrated in FIG. 1.

Each end of the moveable contact arm 28 extends into a separate arc extinguishing chamber. The two arc extinguishing chambers are mirror images of each other with one chamber 34 visible in FIG. 1. Arc extinguishing chamber 34 is formed by two stacks 36 and 38 of spaced apart splitter plates with a gap 39 between the stacks. Each stack 36 and 38 comprises a row formed by two types of splitter plates 40 and 42 which are interleaved in an alternating manner along the stack. Note that the top splitter plate in the innermost stack 36 is connected by a wire braid to the other power terminal than the one that the stack is beneath. Specifically the top splitter plate 40*a* in the innermost stack 36 beneath the second power terminal 16 is connected by a wire braid 41 to the first power terminal 14. Another wire braid 43 connects a splitter plate of the arc extinguishing chamber beneath the first power terminal 14 to the second power terminal 16.

The first type of splitter plate 40 is shown in detail in FIG. 2 and has an outer U-shaped casing 44 with a closed curved end facing the center gap 39 of the arc extinguishing chamber 34 as illustrated in FIG. 1. The casing 44 is formed of a non-ferrous, electrically conductive material, such as copper, and extends around a body 46. This body 46 has a non-magnetic inner member 48, of aluminum or plastic for example, which nests into the bottom of the opening of the U-shaped casing 44. This inner member 48 has an aperture 50 therethrough with half of the diameter of the aperture located within a convex protrusion 52 of the inner member. A permanent magnet 54 is positioned within the aperture 50 of the inner member 48 of the body 46 with the poles of the magnet 54 located at the outer surfaces of the inner member which abut the casing 44. The body 46 also has an outer member 56, of a magnetic material such as iron, which fits against the inner member 48 within the U-shaped casing 44. The outer member 56 has a curved concave notch 58 that mates with the convex protrusion 52 of the inner member 48 so that the outer member extends around half of the permanent magnet 54 and acts as a magnetic flux guide. The orientation of the permanent magnet 54 establishes a separate magnetic field around each one of the first type of splitter plates.

Referring again to FIG. 1, the second type of splitter plate 42 is a U-shaped piece of non-ferrous, electrically conductive material, such as copper. The closed curved end of each second splitter plate 42 faces the center gap 39 of the arc extinguishing chamber 34 when stacked in an alternating fashion with the first splitter plates 40. In both stacks 36 and 38, the first splitter plates 40 are oriented with the like poles of their magnets facing each other. In one stack for example, the north pole of the top first splitter plate 40 faces upward in FIG. 1. The south pole of the next first splitter plate 40 is directed upward, thereby facing the south pole of the top first splitter plate, with a second splitter plate 42 positioned therebetween. The third one of the first splitter plates 40 in the stack has an upward oriented north pole. Subsequent first splitter plates in the stack continue to be oriented with this alternating magnetic polarization.

Because the contactor 10 switches direct current, another magnetic field is employed to move electric arcs into the arc extinguishing chamber 34. Referring to FIG. 3, that magnetic field is produced across gap 39 of arc extinguishing chamber 34 by a permanent magnet assembly 60. This assembly comprises a permanent magnet 62 located outside the plastic housing 64 of the arc extinguishing chamber 34 along the height of that chamber. The permanent magnet 62 is magnetically coupled to a pair of iron, U-shaped members 66 and 68 that abut the outside surface of this magnet and extend around opposite sides of the arc extinguishing chamber 34. A pair of plastic brackets 70 and 72 hold the splitter plates 40 and 42 in notches of the plastic housing 64 and close that housing. The coupling of permanent magnet 62 with U-shaped members 66 and 68 establishes a magnetic field across the arc-extinguishing chamber 34 (vertically in FIG. 3), which directs electric arcs formed between the contact pads 30 and 32 toward the splitter plates 40 and 42, as will be described.

With reference to FIG. 1, when the contactor 10 opens, the armature 22 and the attached contact arm 28 move away from the stationary contacts 15 and 17 which causes the contact pads 30 and 32 to separate and move into the position shown. As the contact pads 30 and 32 separate, an arc 77 may form therebetween. The force produced by the interaction of the arc current with the magnetic field from the outer permanent magnet 62 (FIG. 3) causes the arc 77 to move from contact pad 32 outward along the stationary contact 17 toward the outside stack 38 of the arc extinguishing chamber 34. At the same time, the arc 77 moves off the other contact pad 30 onto the tip of the moveable contact arm 28.

As the contact pads 30 and 32 continue to separate, the arc propagates along the stationary contact 17 and onto the top splitter plate in the outer stack 38. The arc then bridges the gaps between adjacent splitter plates 40 and 42 in the outer stack 38. Eventually the arc travels down the outer stack to the point where the other end of the arc travels onto the top splitter plate 40*a* in the inner stack 36. When the arc 77 attaches to the top plate 40*a* in the inner stack 36, the arc in the other arc extinguishing chamber for stationary contact 15 is shorted out and fully extinguished because of the connection of that top plate 40*a* to the opposite power terminal 14 by wire braid 41.

However, arc 77 is not extinguished at that time and continues propagating further downward to each subsequent splitter plate 40 and 42 in each stack. This action forms a separate sub-arc in the gap between adjacent splitter plates 40 and 42. Eventually the arc 77 spans a sufficient number of gaps between the splitter plates building up significant arc voltage and extinguishing the arc.

As the arc travels into the arc extinguishing chamber 34, it also interacts with the individual magnetic fields produced by permanent magnet 54 in each of the first type of splitter plates 40. Specifically each of these interior magnets 54 produces a field extending around its respective first splitter plate 40 as depicted by lines 78 in FIG. 4. The interaction of the arc current with this magnetic field around each plate causes the arc 77 to move in circles on the surface of the splitter plate casing 44. Thus the arc energy is not constricted to one spot on the casing surface as occurred in previous arc chambers, thus erosive effects of arcs impinging the splitter plates are reduced in the present design.

The outer member 56 of each first splitter plate 40 acts as a flux guide. If this member was made of non-magnetic material like the inner member 48, the magnetic flux line would travel around the outside edge 79 of the splitter plate and strike the adjacent U-shaped member 66 or 68 of the arc extinguishing chamber, as evident in FIG. 3. Because the U-shaped members 66 or 68 are magnetically polarized by the permanent magnet 62 outside the arc chamber housing, they short out the magnetic flux lines 78 at the outside portion of the first splitter plate 40. Therefore the flux lines do not travel around the outside edge of the first splitter plate and do not travel to the bottom of the splitter plate casing 44 in FIG. 4. Thus an arc at that outside portion of the bottom surface will not encounter an magnetic field and will not move about the bottom surface of the casing 44.

However by making the outer member 56 of magnetic material, such as iron, the outer member guides the magnetic flux through the portion of the first splitter plate adjacent outside edge 79. After passing through the outer member 56 these flux lines emerge from the bottom of casing 44 and curve through the air to the middle section of the bottom casing surface. Thus a magnetic field is established across the entire top and bottom surfaces of each first splitter plate so that no matter where an arc strikes those surfaces, the arc will interact with the magnetic field causing movement of the arc about the casing surface.

We claim:

1. An electric current switching apparatus comprising:

first and second power terminals;

a stationary contact electrically connected to the first power terminal;

a movable contact which selectively engages the stationary contact to complete an electrical connection between the first and second power terminals;

an electrical conductor coupling the movable contact to the second power terminal;

an actuator for moving the movable contact into and out of engagement with the stationary contact; and an arc extinguishing chamber having a plurality first splitter plates adjacent to the movable and stationary contacts and arranged to provide a plurality of gaps each gap formed between adjacent ones of the plurality of first splitter plates, wherein an arc formed between the stationary contact and the movable contact is extinguished by dividing the arc among the plurality of gaps, each of the plurality of first splitter plates has an element having a surface of a non-ferrous, electrically conductive material and has a magnet that produces a magnetic field around the element which causes the arc to move about the surface of the element.

2. The electric current switching apparatus as recited in claim 1 wherein each of the plurality of first splitter plates comprises:

a member of non-magnetic material with an aperture within which the magnet is received; and wherein the element is a casing formed of a non-ferrous, electrically conductive material extending at least partially around the member.

3. The electric current switching apparatus as recited in claim 1 wherein one of the plurality of first splitter plates is electrically connected to the second terminal.

4. The electric current switching apparatus as recited in claim 1 wherein each of the plurality of first splitter plates comprises:

a first member of non-magnetic material with an aperture within which the magnet is received;

a second member of a magnetic material abutting the first member; and wherein the element is a casing formed of a non-ferrous, electrically conductive material extending at least partially around the first and second members.

5. The electric current switching apparatus as recited in claim 4 wherein the first member has a curved edge; and the casing is U-shaped with a curved inner surface against which the curved edge abuts.

6. The electric current switching apparatus as recited in claim 4 wherein the second member has a notch within which a portion of the magnet is located.

7. The electric current switching apparatus as recited in claim 1 further comprising a plurality of second splitter plates interleaved with the plurality of first splitter plates.

8. The electric current switching apparatus as recited in claim 7 wherein each one of the plurality of second splitter plates has a U-shape.

9. The electric current switching apparatus as recited in claim 1 further comprising a magnet assembly adjacent to both the stationary contact and the movable contact and establishing a magnetic field that causes an electric arc to move into the arc extinguishing chamber.

10. An electric current switching apparatus comprising:

a stationary contact;

a movable contact which selectively engages the stationary contact to complete an electrical path;

an actuator for moving the movable contact into and out of engagement with the stationary contact;

an arc extinguishing chamber adjacent to the movable and stationary contacts and including two rows of splitter plates with a gap therebetween, the splitter plates in each row being spaced apart from each other, each splitter plate having a first member of non-magnetic material with an aperture within which a permanent magnet is received and having a casing formed of a non-ferrous, electrically conductive material extending at least partially around the first member, the permanent magnet producing a magnetic field around the splitter plate which causes an electric arc to move about the casing; and a magnet assembly adjacent to the stationary contact and the movable contact to establish a magnetic field that causes an electric arc to move into the arc extinguishing chamber.

11. The electric current switching apparatus as recited in claim 10 wherein each splitter plate further comprises a second member of a magnetic material abutting the first member and having a notch within which a portion of the permanent magnet is located, and wherein the casing extends over part of the second member.

12. The electric current switching apparatus as recited in claim 10 wherein the first member has a curved edge facing the gap; and the casing is U-shaped with a curved inner surface against which the curved edge abuts.

13. An electric current switching apparatus comprising:

a stationary contact;

a movable contact which selectively engages the stationary contact to complete an electrical path;

an actuator for moving the movable contact into and out of engagement with the stationary contact;

an arc extinguishing chamber adjacent to the movable and stationary contacts and including two rows of splitter plates with a gap therebetween, the splitter plates in each row being spaced apart from each other, each row formed by a group of a first type of splitter plate interleaved with a group of a second type of splitter plate, wherein the first type of splitter plate has a first member of non-magnetic material with an aperture within which a permanent magnet is received and has a casing formed of a non-ferrous, electrically conductive material extending at least partially around the first member, the permanent magnet producing a magnetic field around the first member which causes an electric arc to move about the casing; and a magnet assembly adjacent to the stationary contact and the movable contact to establish a magnetic field that causes an electric arc to move into the arc extinguishing chamber.

14. The electric current switching apparatus as recited in claim 13 wherein each first type of splitter plate further comprises a second member of a magnetic material abutting the first member and having a notch within which a portion of the permanent magnet is located, and wherein the casing extends over part of the second member.

15. The electric current switching apparatus as recited in claim 13 wherein the first member has a curved edge facing the gap; and the casing is U-shaped with a curved inner surface against which the curved edge abuts.

16. The electric current switching apparatus as recited in claim 13 wherein each second type of splitter plate has a U-shape with a curved end facing the gap.

17. An electric current switching apparatus comprising:

first and second power terminals;

a stationary contact electrically connected to the first power terminal;

a movable contact which selectively engages the stationary contact to complete an electrical connection between the first and second power terminals;

an actuator for moving the movable contact into and out of engagement with the stationary contact; and an arc extinguishing chamber comprising a plurality of splitter plates which are adjacent to the movable contact and the stationary contact, and each of the plurality of splitter plate includes an element that causes an electric arc to spin across a surface of one of the plurality of splitter plates.

18. The electric current switching apparatus as recited in claim 17 wherein the element is a magnet that produces a magnetic field around one of the plurality of splitter plates.

19. The electric current switching apparatus as recited in claim 1 wherein the magnet of each splitter plate is a permanent magnet.

* * * * *